US006840855B2

(12) United States Patent
Stern, Jr.

(10) Patent No.: US 6,840,855 B2
(45) Date of Patent: Jan. 11, 2005

(54) APPARATUS FOR AND METHOD OF PLAYING GAMES OF CHANCE

(76) Inventor: Max Stern, Jr., 6351 Chisos Dr., Las Vegas, NV (US) 89103

( * ) Notice: Subject to any disclaimer, the term of this patent is extended or adjusted under 35 U.S.C. 154(b) by 4 days.

(21) Appl. No.: 09/981,463

(22) Filed: Oct. 17, 2001

(65) Prior Publication Data

US 2002/0068621 A1 Jun. 6, 2002

Related U.S. Application Data

(60) Provisional application No. 60/241,020, filed on Oct. 17, 2000.

(51) Int. Cl.[7] ..... A63F 9/24
(52) U.S. Cl. ..... 463/16
(58) Field of Search ..... 463/11–13, 16–22, 463/40–42, 25, 29; 273/292, 143 R, 274, 309, 138.1, 138.2, 236–237, 293, 269, 303

(56) References Cited

U.S. PATENT DOCUMENTS 5,042,818 A * 8/1991 Weingardt ..... 463/13
5,624,119 A * 4/1997 Leake ..... 463/19
5,976,016 A * 11/1999 Moody et al. ..... 463/13
6,098,985 A * 8/2000 Moody ..... 463/13

* cited by examiner

*Primary Examiner*—Mark Sager
(74) *Attorney, Agent, or Firm*—Jeffrey C. Maynard

(57) ABSTRACT

A method and apparatus for playing a game of skill and chance for one or more players, in which colored, numbered balls comprise the contest elements. Players can bet on obtaining predetermined combination of elements. Players are permitted to reject some or all elements and receive substitute elements to complete a final combination of elements. The final combination is evaluated against a predetermined pay table of values to determine the pay out, if any, to the player. Apparatus may include electronic or mechanical game machines.

11 Claims, 5 Drawing Sheets

APPARATUS FOR AND METHOD OF PLAYING GAMES OF CHANCE

This Application claims the benefit of U.S. Provisional Application, Ser. No. 60/241,020 entitled Apparatus for and Method of Playing Games of Chance, filed with the U.S. Patent and Trademark Office on Oct. 17, 2000.

BACKGROUND OF THE INVENTION

1. Field of the Invention

The present invention relates to new games of chance and to a method and apparatus for playing games of chance. In particular, the present invention relates to new games of chance for video gambling machines, computer games, or other electronic or mechanical devices. In its more particular embodiments, the present teachings specifically pertain to a game of chance in which a player uses random chance contest elements, such as numbered colored balls, to obtain a particular winning combination of subsets of the chance elements, relying on observations and luck.

2. Background of the Prior Art

Games of chance have had appeal throughout history. Some games of chance have had a popularity that has endured for hundreds of years. For instance, games of chance involving dice have also been played for more than five hundred years. Games of chance played with cards having indicia such as hearts, diamonds, spades, and clubs have been played for over one hundred years. Games of chance involving slot machines having indicia such as lemons, cherries, apples, and so forth, have been played for nearly one hundred years.

Slot machines typically have 3, 4 or more reels, with a number of different indicia located on each reel. Upon activation of the machine by a player placing a bet, the reels spin for some time, and then stop. A stopped combination of symbols appears along a winning line across the front of the reels. If the symbol combination as stopped coincides with a specific winning combination, the player is given one of the various wins preset in the slot machine. Those wins are ranked differently as to prizes and advantages to be given to the player. If the reels stop in a position where the indicia displayed on the reels form a predetermined winning combination, the player is a winner and receives a payout. If the reels stop in a position in which the indicia form a losing combination, the player loses his bet.

Similar machines utilize video screen technology in the place of spinning reels, but involve essentially the same game of chance.

Another popular game of chance is "video poker." In this game, a player bets that he or she will be able to create a predetermined hand from a number of dealt cards, the cards illustrated on video screen displays.

The electronic video poker gaming machine is designed to replicate the play of a hand of poker. A gaming computer electronically shuffles the deck of cards, activates the dealing sequence in response to input by a player, causes the cards to be displayed on the video screen display, and analyzes the hand to determine winning and losing hands. Computer controls also affect payouts to the player based on the amount of the player's wager and the poker ranking of the hand. A player places a bet, such as by inserting a coin or playing a credit to start the game. The machine then "deals" five cards to the player, displaying them on a video screen. The player elects whether to keep any or all of the cards, and then instructs the machine to replace any discarded cards. If the resulting five cards form a predetermined winning hand, then the player is a winner and is paid a winning amount. If the player does not receive a predetermined winning hand, the player is a loser and the machine retains his bet. Typically, a player is not playing against any other players or against a dealer's hand; the player is simply attempting to achieve the highest-ranking poker hand possible from the cards displayed to the player.

The higher the poker hand achieved by the player, the greater the player's winnings based on the number of coins, tokens or credits wagered by the player. Typically, a payout schedule is posted on the gaming machine to advise the player of the payoffs available for certain winning card combinations. While skill is involved in these games, the games primarily depend upon luck in achieving particular card arrangements by following several rules of the game.

Despite the popularity of games of chance, these games present several disadvantages to the casinos and players alike. Players have become bored with traditional video poker. Furthermore, players prefer to play machines that have pay tables with high payouts for the types of winning combinations that are achievable. Gaming casino operators are desirous of having different types of electronic games to offer to players.

Although there have been attempts to improve upon existing games and to develop new games of chance, there exists a need for a game that more closely meets the player's needs for excitement, risk, risk management, quickly and easily understood play, and possibility of success. At the same time, the game must meet the casinos' prerequisite for profitability from the use of the game.

A need exists for a wagering game that is intended to be played in gambling casinos, that is simple to learn and play, and that results in increased revenues for the casino. There is a need for new video gaming machines that are capable of encouraging a high volume of play while at the same time offering what the players consider to be good pay tables. There is a need to provide new and interesting electronic video games that attract players and that can increase the volume of wagering in each gaming machine.

The present invention fulfills these needs. It is a simple game of consistent rules, player participation, choices of risk offered by a variety of methods of placing wagers, and corresponding to varying payout. The house edge is fairly derived and players will detect this fairness through the payout odds. These features will increase the number of players to the game, both experienced and inexperienced players, generating satisfaction in the players and profitability to the casino.

SUMMARY OF THE INVENTION

An object of the present invention is straightforward entertainment with some of the skill, guess and atmosphere of a casino.

Another object is to enable a participant to choose from a variety of possible combinations of chance elements to play a game of skill and chance.

Another object is to enable implementation of a novel game of chance by a gaming establishment, such as a casino, which supervises and controls the flow of the game for a predetermined, but non-participatory, fee.

A further object is to enable adaptation of the invention to usage independent of a gaming establishment, including individual personal usage.

Another object is to promptly provide visible winning results, solely for entertainment purposes, or additionally for wagering, such that a casino atmosphere of chance is available for a single, or for a plurality of participants.

Another object is to enable a participant, or plural participants, to play more than one hand in a single round of the game being played.

Another object is implementation of supervision and control of the flow of a game by software, or by gaming establishment personnel.

It is a principal object of the present invention to provide a completely new and interesting game of chance, which will attract players by offering the player a good pay table.

It is another object of the present invention to provide an electronic video game machine capable of playing a game of chance easily even by a beginner.

It is yet another object of the invention to provide methodology for playing new and interesting games of chance wherein the games encourage a high amount of individual player interest while maintaining acceptable payback percentages.

It is a further object of the invention to provide a video gaming machine apparatus, which displays a new and interesting game of chance that encourages a high amount of individual player interest while maintaining acceptable payback percentages.

The method of play is as follows. A player places a bet and activates the machine. The player plays the game. If the result of the game is a predetermined winning combination, the player receives a winning payout. If the result of the game is a predetermined losing combination, the player loses the bet.

In brief, the objects and advantages of the present invention are achieved by a game having a video display and a processor for enabling a player to play, and a method of playing such game. A payout table of values of winning combinations is displayed for viewing by the player. A player's bet is received and displayed. A plurality of objects is randomly selected and is then displayed. Game results are evaluated and displayed responsive to the randomly selected and displayed objects.

The goal of the game is to play skillfully with the random chance elements by taking advantage of an opportunity to hold some, or all elements, or exchange for additional chance elements. A player can achieve a winning combination of elements according to a defined table of values. If the final combination of elements contains a winning combination, the player receives payment on his wager according to the table of values. If the final combination of elements does not contain any winning combination according to the table of values, that player loses his wager.

Whether solely for amusement or for entertainment with wagering, an electronic video game machine can be used. Random chance elements can be displayed in an electronic or other machine play apparatus.

Among the advantages of the invention are the simplicity of play and ease of administration. This invention provides a novel game that is easy to administer and fun to play.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

Figure 1:
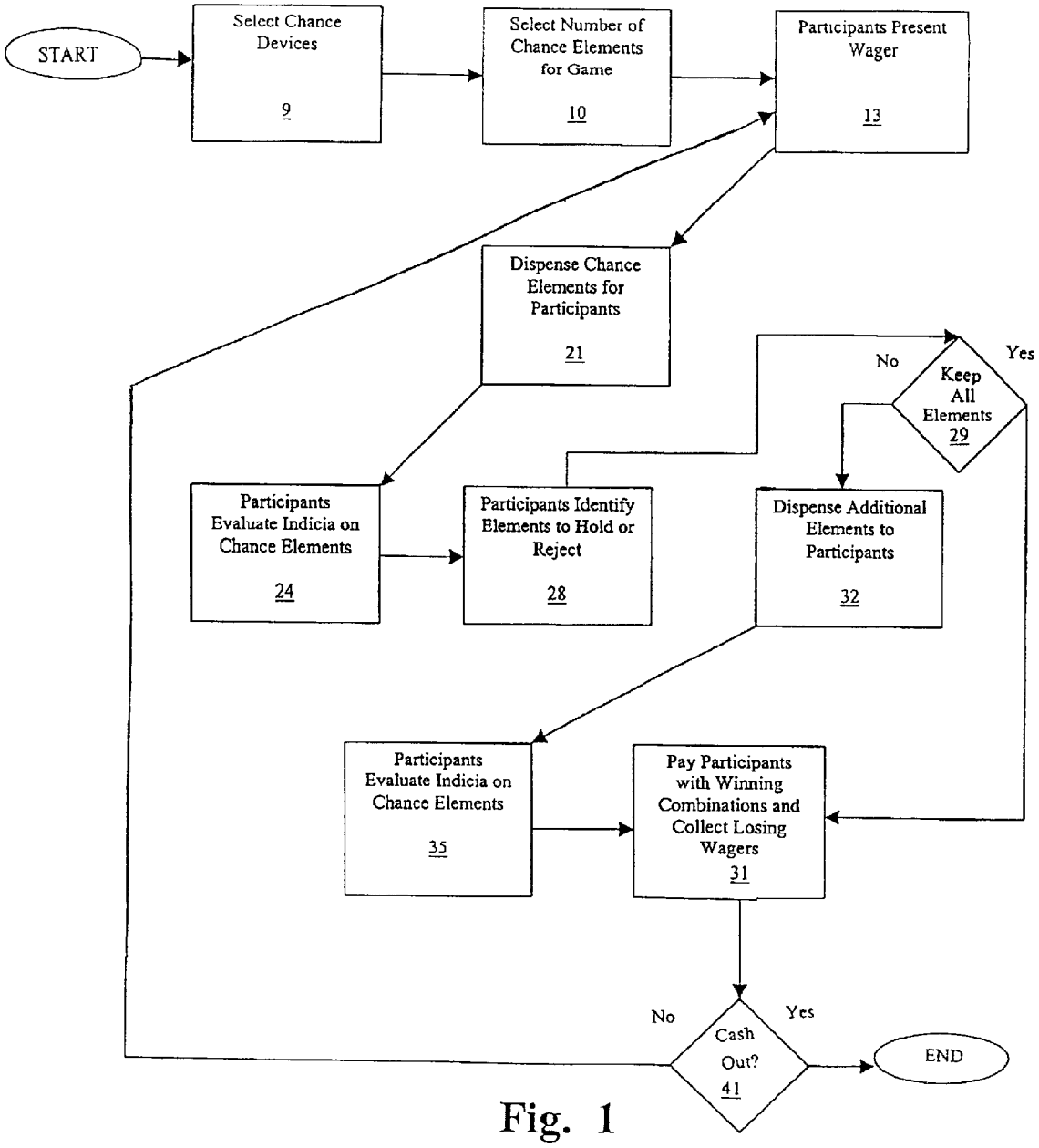
FIG. 1 is a flow chart illustrating steps of a specific embodiment of the invention.

The invention summarized above and defined by the enumerated claims may be better understood by referring to the following detailed description, which should be read in conjunction with the accompanying drawings in which like reference numbers are used for like parts. This detailed description of an embodiment, set out below to enable one to build and use an implementation of the invention, is not intended to limit the enumerated claims, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

Play of the novel game disclosed herein involves a predetermined plural number of sets of contest elements. In a preferred embodiment, two hundred (200) chance elements having indicia on the surface thereof representing the numbers 1 thru 10 respectively are provided for play. The two hundred elements are subdivided into five (5) sets having four (4) subgroups of ten (10) elements each, for a total of forty (40) elements per set. The elements, however, are not all the same color. Each set should be a different color; for example, a first set may comprise forty (40) black elements having four identical subgroups of elements numbered one (1) to ten (10), a second set may comprise forty (40) red elements having four identical subgroups of elements numbered one (1) to ten (10), a third set may comprise forty (40) green elements having four identical subgroups of elements numbered one (1) to ten (10), a fourth set may comprise forty (40) yellow elements having four identical subgroups of elements numbered one (1) to ten (10), and a fifth set may comprise forty (40) blue elements having four identical subgroups of elements numbered one (1) to ten (10). One unit comprises five sets of different colors. Although the games are designed to be played with five sets of chance elements (one unit), the games can be played by using as many units, complete or incomplete, as desired.

Referring to a specific embodiment, further shown and described in more detail in relation to the drawings, FIG. 1 represents the sequence of steps establishing and carrying out a specific embodiment of the method of the invention.

Station 9 indicates selection of chance elements for a game. The chosen game is played on a machine, in a casino, in a club or in a home. The game can be played with colored balls, or whatsoever kind of objects containing elements that can be subdivided into the same distribution as described;

that is, five sets of forty (40) numbered elements, each set of elements of differing colors, forms, and objects further subdivided into four identical subgroups.

In the second step, at station 10, the number of chance elements for a game is selected. In a preferred embodiment, a game is played using three chance elements in an initial 'hand'. Alternate embodiments can be played using four or more contest elements.

In the third step, depicted at station 13, if not earlier, a player presents a wager, signifying an ante or cost to participate. For play of the game, each player selects a quantitatively fixed wager for every game. The amount of the wager may not be increased or decreased during the later-described stages of the invention, as the game is being played. The host establishment can prescribe a minimum and maximum wager for each individual game. (The apparatus for home game play enables selective determination if wagering is to be involved.) Such a quantitatively fixed wager is made for each 'hand', if that participant selects to play more than one 'hand'. A minimum and maximum for competitive wagering can be prescribed for an individual round. Present concepts can provide for handling differing wagering amounts for one or more participants. In a specific embodiment, the host establishment can require an entry fee for participation in the game as well as a wager for each game. Personal wagering is estimated based on factors including experience in obtaining one or more 'hands' with a winning combination of elements in the game to be played, after elements have been dispensed. Payout for winning combinations may be dependent upon the amount of the wager.

In the fourth step, at station 21, the preselected number of chance elements is displayed for the player. In one embodiment, three of the two hundred elements are dispensed for such player.

In the fifth step, at station 24, the player evaluates the combination of elements dispensed for that player against a selected table of values, such as shown in TABLE I, for each combination of elements in the game. Combinations depend on the indicated number and color of each element.

In the sixth step, represented by reference number 28, the player can reject from zero to all of the original elements received; or, such player can keep all the elements or change some, or all, of the elements. A player decides which, if any, elements should be kept or rejected, depending on his or her skill, expertise, and risk acceptance.

If the player elects to keep all the elements in the original combination (presumably a winning combination), represented by reference 29, the player is rewarded for the combination of elements according to the payout table for the selected game, as indicated at station 31.

Otherwise, additional chance elements are selectively distributed from the remaining elements in the initial unit to the player, indicated by station 32, in accordance with the number of elements rejected by the player in the sixth step (station 28).

In the next step, at station 35, the new combination of elements 'held' by the player is evaluated against a predetermined pay table. A ranking for each 'hand' displayed is evaluated according to rankings as shown in TABLE I. With completion of respective changes, the round is complete and the player wins or loses more or less than that player's original wager, according to the game played.

In the final step, indicated by station 31, each player with a winning combination of elements, which player has not been previously rewarded, is paid according to the rank for each such winning 'hand'. A player with a winning combination of elements is paid on his wager, according to the scale of values of the game, such as shown in TABLE I. A player without a winning combination of dice, according to the scale of values, loses his or her wager.

The player then decides, at station 41, whether to continue playing or to withdraw his or her winnings, if any. If the player chooses to play again, such player presents a wager at station 13 and proceeds through the method steps again.

In a preferred embodiment, an electronic video game machine that does not compete against the player controls the game. The steps and functions of a controller are established by software and take place electronically in video games to provide and distribute electronic designations of game elements, to maintain control of play of the game for plural players, and to sequence the steps of the game properly, while providing for selections made by a player, or players. Such game controller is also responsible for collecting wagers that are lost and making payments to winners, according to the selected pay table. The electronic video game machine provides functions to randomize the chance elements, to distribute the elements to a player, or players, and to keep control and order to the steps of the game. The electronic video game machine automatically collects the wagers from the losers and makes payments to the winners.

An electronic video gaming machine upon which the method of the present invention can be practiced is well known in the art. The gaming machine includes a video display screen, a coin slot into which players may introduce coins or tokens and may also include a bill acceptor into which players may introduce paper currency, all of which are conventional in electronic video gaming machines.

As is also conventional, buttons are provided by which a player operates the gaming machine to cause elements to be displayed, held and rejected. A cash out button is also provided to cause any credits accrued to be cashed out by the player. Instead of using buttons to operate the gaming machine, conventional touch screen technology can also be used. Any suitable electronic video gaming machine can be modified so that the method of the present invention can be practiced thereon.

Fundamental concepts of the invention are explained in relation to a preferred embodiment based on use of two hundred contest elements subdivided into five sets; that is, one unit, for example, one set comprising forty (40) black elements having four identical subgroups of elements numbered one (1) to ten (10), one set comprising forty (40) red elements having four identical subgroups of elements numbered one (1) to ten (10), one set comprising forty (40) green elements having four identical subgroups of elements numbered one (1) to ten (10), one set comprising forty (40) yellow elements having four identical subgroups of elements numbered one (1) to ten (10), and one set comprising forty (40) blue elements having four identical subgroups of elements numbered one (1) to ten (10) are used.

Figure 2:
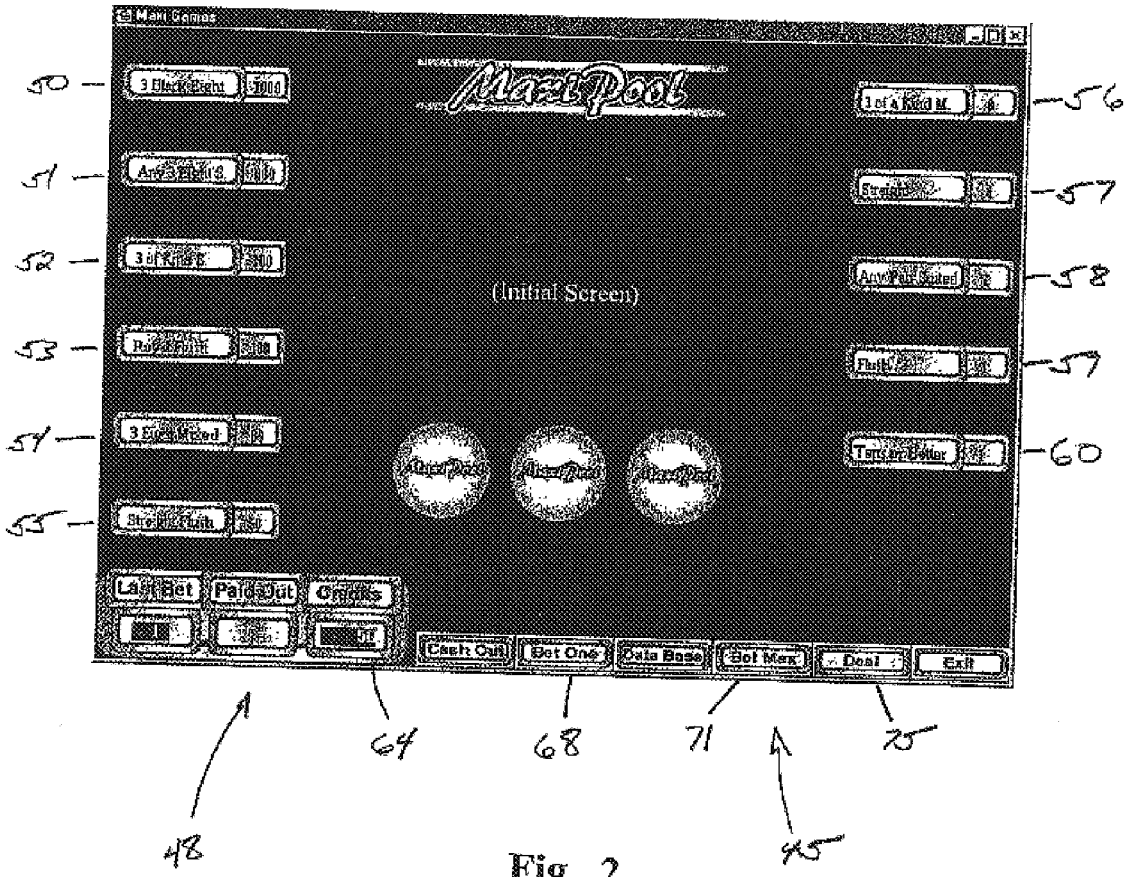
FIG. 2 shows a front elevational view of an electronic video gaming machine display for describing specific steps of one embodiment of the present invention.

Referring now to FIG. 2, there is presented a video screen display 45 for an exemplary embodiment of the present invention. Display screen 45 is sized to display three contest elements as well as an area to display wagers and credits 48 and indications of values for winning combinations of elements 50, 51, 52, 53, 54, 55, 56, 57, 58, 59, 60, such values as shown in TABLE I. The player introduces coins or gaming tokens into a coin slot or paper currency into a bill acceptor to activate the gaming machine. Any coin, token, or value from paper currency introduced into the electronic video game machine is indicated as credits in window 64 on video screen 45. The player indicates the desired number of coins, tokens or credits to wager using touch-sensitive button 68. The player can wager the entire amount of available credits by using touch-sensitive button 71. To cause the initial deal of dice to be displayed on the video screen, the player activates the random number generator within the gaming machine by pressing touch-sensitive "Deal" button 75 on screen 45.

In a preferred embodiment of the present invention, three elements from a single unit of two hundred contest elements are displayed on video screen 45. In an alternate embodiment, additional complete or incomplete units may be used. In a further embodiment, 4 or more elements may be displayed.

Figure 3:
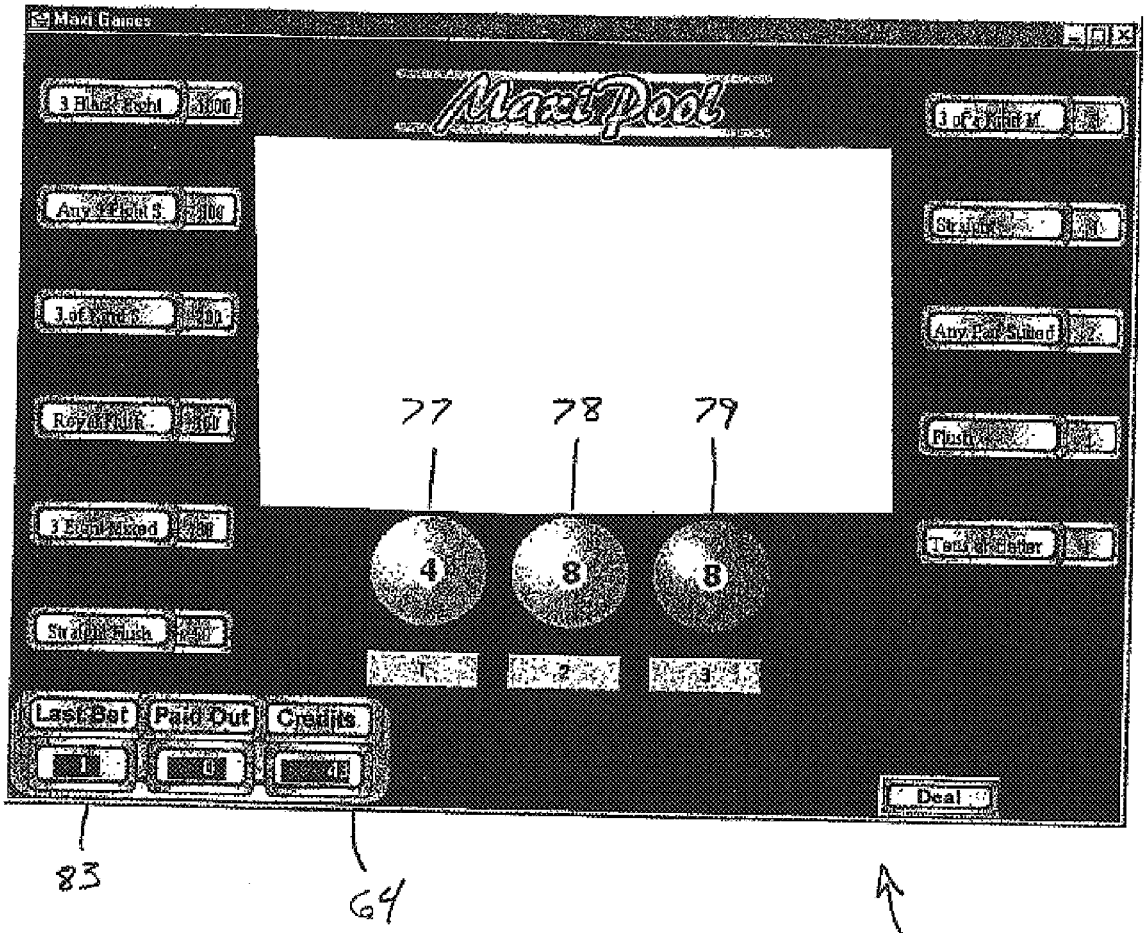
FIG. 3 shows a front elevational view of an electronic video gaming machine display for describing additional steps of one embodiment of the present invention.

In the example shown in FIG. 3, the player is dealt a red 4 (77), a red 8 (78), and a blue 8 (79). Any coins, tokens, or value from paper currency introduced in excess of the amount the player wishes to wager are accrued as credits shown in window 64. Controls in the electronic video machine automatically maintain accounting of the value of credits expended. The amount of the last wager is also displayed at 83. The player then selects which of the initial three elements the player wishes to hold by pressing the video screen 45 at the location of the element the player wishes to hold.

In this example, the player would most likely hold the red 8 (78) and the blue 8 (79). The red 4 (77) would be rejected and a replacement element from the original remaining unit of elements would be displayed on video screen 45.

Figure 4:
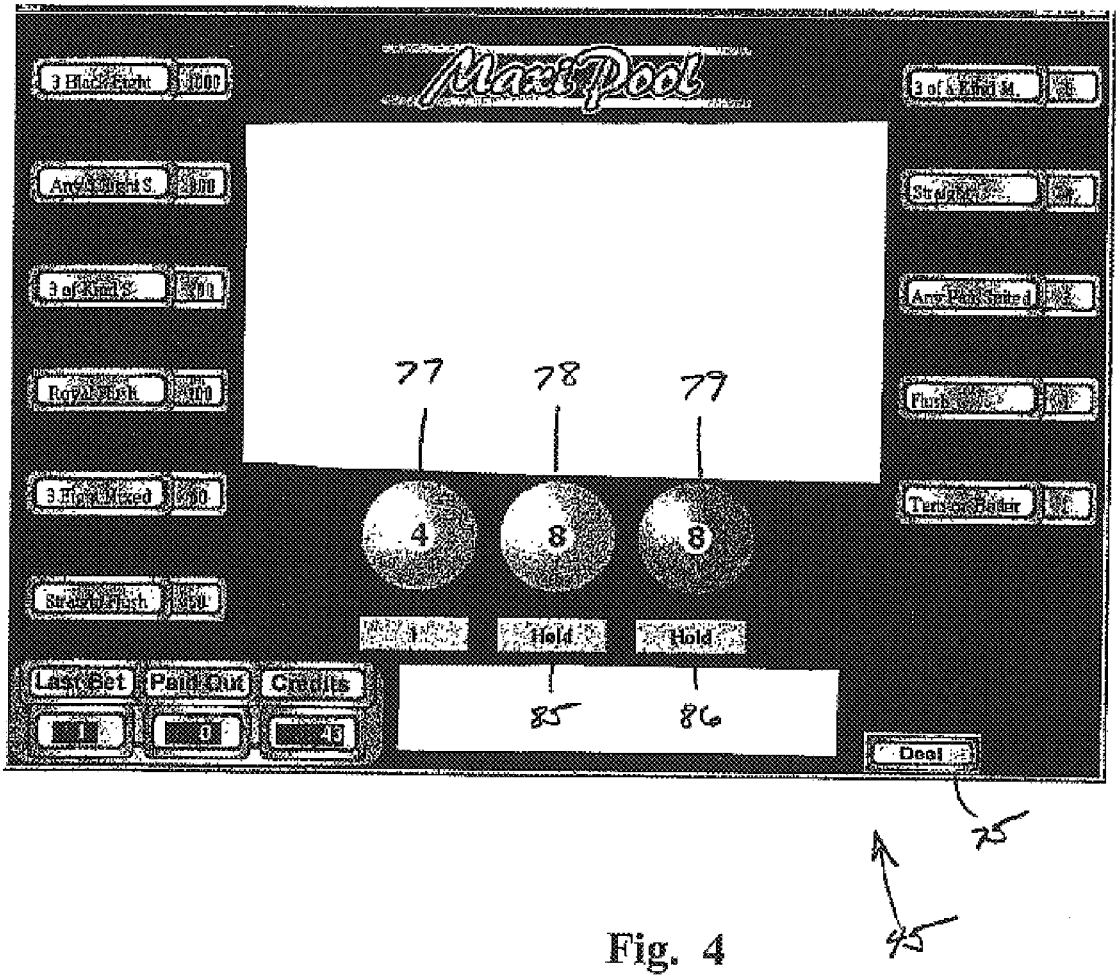
FIG. 4 shows a front elevational view of an electronic video gaming machine display for describing further additional steps of one embodiment of the present invention.

FIG. 4 shows an example of video screen display 45 after the player has selected which elements to hold from the initial display, as indicated by hold buttons 85 and 86. The player presses Deal button 75 to cause a replacement element from the original remaining unit of elements to be displayed on video screen 45.

Figure 5:
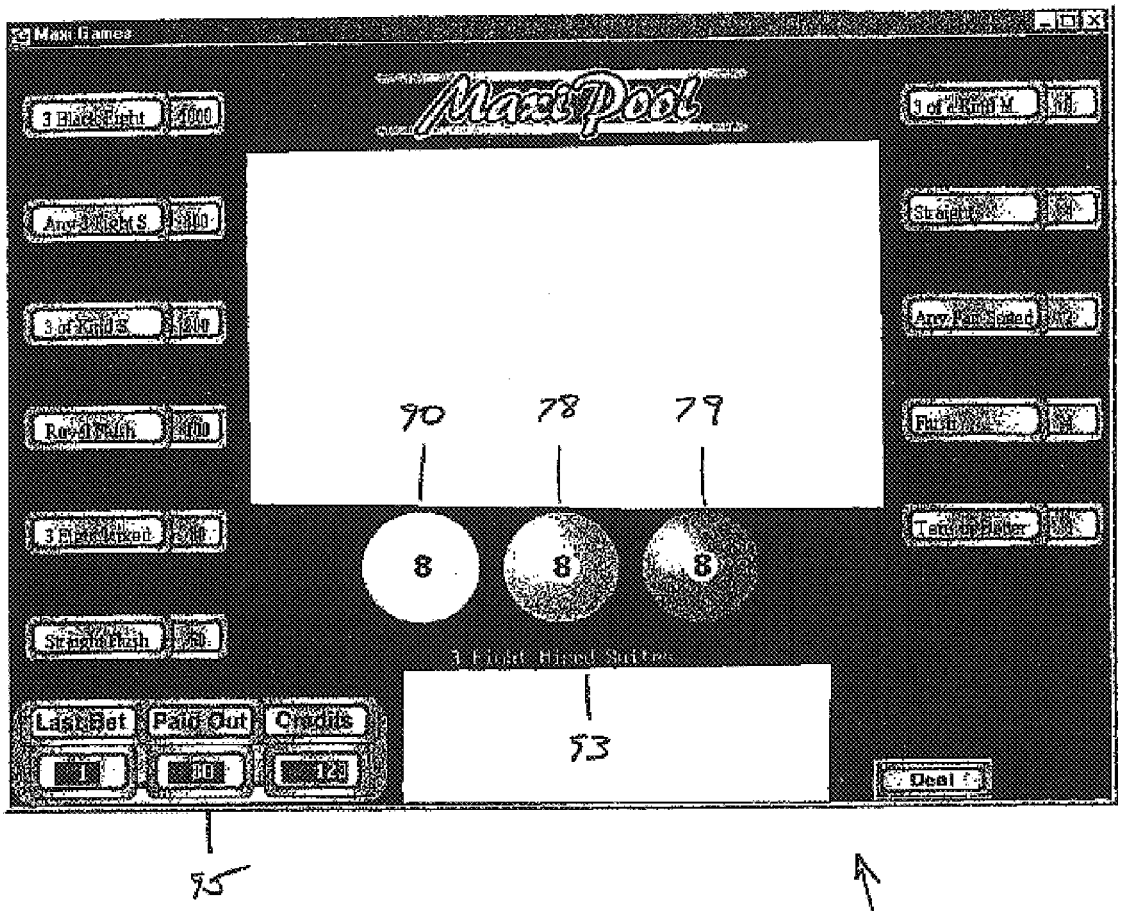
FIG. 5 shows a front elevational view of an electronic video gaming machine display for describing final steps of one embodiment of the present invention.

In the example, FIG. 5, the player receives a yellow 8 (90) as the replacement element to combine with the red 8 (78) and blue 8 (79).

In the final combination, the player has achieved three eights, mixed colors, as indicated at 93. Since this represents a winning combination, the player receives a pay out 95 according to a predetermined payout table of values, such as TABLE I. Such pay table reflects the probabilities of obtaining particular combinations of elements, based on the number of contest elements in a complete unit.

The amount that the player wins is displayed on screen 45 at reference number 95 and is based on the ranking of the 'hand' achieved by the player and the amount wagered by the player. If a player's final 'hand' contains a winning combination of elements, the player receives payment on his or her wager. If a player's final 'hand' does not contain a winning combination of elements, that player loses his or her wager.

As can be seen from the description of the embodiments, the present invention is readily adaptable to play on a computer or video game. A person skilled in the art of computer and video game construction, as well as those skilled in other arts, will incorporate the method and conduct of this invention in such computer and video games.

A preferred embodiment of the invention comprises a video game of chance, for an individual player, wherein the apparatus methodology comprises the steps of:

a) machine acceptance from the game player of an initial "bet" wager via a coin or token entry slot of the machine or from the player's machine credit bank;

b) machine random dealing and video display of three chance devices to the player from the electronic bank of 200 multicolored random chance elements;

c) permitting the player, after viewing his or her displayed 'hand', via appropriate machine control buttons, to either: stand on the hand as dealt, or reject one or more of the original chance elements with replacement of such rejected elements with machine dealt elements;

d) machine random dealing from the remainder of the bank and video display of replacement elements in a final player's 'hand'; and e) machine evaluation of the player's final 'hand' with respect to the pay table of winning hands for the disclosed video game of the machine and pay-off to the player's machine credit bank of an appropriate amount of coins or tokens for a winning 'hand' according to the pay table of winning hands as related to the number of coins or tokens wagered.

The game is preferably played in video game machines, mechanical game machines, computers, and hand-held, mechanical or video game devices. An electronic video game machine can enable a single player to play more than one 'hand' at a time and can be used to accommodate plural players.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein. Therefore, for purposes of determining the scope of patent protection, reference shall be made to the appended claims in combination with the above detailed description.

TABLE I

| Relative Ranking of Winning Combinations and Prizes | |
|---|---|
| Three Black Eights (any 3 8s of color black) | 1000 |
| Three Eight Flush (any 3 8s of same color) | 800 |
| Three of a Kind Flush (any 3 elements of same value and color) | 200 |
| Royal Flush (10, 9, 8 of same color) | 100 |
| Three Eights Mixed (any 3 8s of different color) | 80 |
| Straight Flush (any 3 sequential elements of same color) | 50 |
| Three of a Kind (any 3 elements of same value) | 8 |
| Straight (any 3 sequential elements of different color) | 4 |
| Pair (any 2 elements of same value and color) | 2 |
| Flush (any 3 elements of same color) | 1 |
| One Pair: Sevens or better (any 2 of 7, 8, 9, 10) | 1 |

What is claimed is:

1. Method for conducting a game for one or more players, comprising (A) providing plural sets of contest elements for such game in which the contest elements comprise balls of unique coloring having selected repetitive playing indicia thereon;

(B) providing a game controller to distribute contest elements to each player in the game;

(C) establishing a table of values for winning combinations of contest elements, such table of values including at least one winning combination in which the combination consists of all elements of a single preselected color and a single preselected indicia;

(D) distributing, by means of such controller, a selected number of contest elements to each player, with each player receiving the same number of contest elements;

(E) enabling each player to evaluate the combination of such received contest elements based on such table of values to elect whether or not to reject one or more contest elements;

(F) permitting each player to selectively reject, for return to such controller, from zero to all contest elements obtained in Step (D);

(G) distributing additional contest elements, by such controller, to each player corresponding to the number of contest elements, if any, rejected in Step (F); and (H) evaluating the combination of contest elements held by each player against such table of values.

2. The method of claim 1, in which the number of sets of contest elements is at least five.

3. The method of claim 1, in which each set of contest elements consists of at least four subsets of such repetitive playing indicia.

4. The method of claim 1, in which the balls are selected from the group consisting of (a) black;

(b)red (c) yellow;

(d) blue; and (e) green.

5. The method of claim 1, in which such repetitive playing indicia comprise representations of numerals 1, 2, 3, 4, 5, 6, 7, 8, 9, 10.

6. The method of claim 1, in which the number of contest elements distributed to each player, is selected from the group consisting of three, four and five.

7. The method of claim 1, further comprising the steps of:

(I) permitting each player to place a wager at the beginning of the game; and (J) paying, by such controller, each player having a winning combination of contest elements, as determined by the table of values according to the player's wager.

8. The method of claim 1, in which such game controller is selected from the group consisting of:

a) electronic video game machines;

b) mechanical game machines;

c) computers;

d) hand-held mechanical devices; and e) band-held video devices.

9. The method of claim 7, in which such game controller is selected from the group consisting of:

a) electronic video game machines;

b) mechanical game machines;

c) computers;

d) hand-held mechanical devices; and e) hand-held video devices.

10. Method for conducting a wagering game for one or more players, comprising (A) providing five sets of balls for such game in which, each such set includes forty balls:

(i) of unique coloring, selected from the group consisting of (a) black;

(b) red;

(c) yellow;

(d) blue; and (e) green;

(ii) subdivided into four subgroups, each such subgroup having selected repetitive playing indicia on their surface area comprising representations of numerals 1, 2, 3, 4, 5, 6, 7, 8, 9, 10;

(B) providing a game controller;

(C) establishing a table of values for combinations of balls, such table of values including at least one winning combination in which the combination consists of all elements of a single preselected color and a singe preselected indicia;

(D) permitting each player to place a wager at the beginning of the game;

(E) distributing, by means of such controller, three balls to each player;

(F) enabling each player to evaluate the combination of such received balls based on such table of values to elect whether or not to reject one or more balls;

(G) permitting each player to selectively reject, for return to such controller, from zero to all balls obtained in Step (E);

(H) distributing additional balls, by such controller, to each player corresponding to the number of balls, if any, rejected in Step (G);

(I) evaluating the combination of balls held by each player against such table of values; and (J) paying, by such controller, each player having a winning combination of balls, as determined by the table of values according to the player's wager.

11. The method of claim 10, in which such game controller is selected from the group consisting of:

a) electronic video game machines;

b) mechanical game machines;

c) computers;

d) hand-held mechanical devices; and e) hand-held video devices.

* * * * *